United States Patent [19]

Kroener

[11] Patent Number: 4,860,270

[45] Date of Patent: Aug. 22, 1989

[54] DRIVE COUPLING

[75] Inventor: Wolfgang Kroener, Pforzheim, Fed. Rep. of Germany

[73] Assignee: Pforzheimer Uhren-Rohwerke PORTA GmbH, Pforzheim, Fed. Rep. of Germany

[21] Appl. No.: 807,457

[22] Filed: Dec. 10, 1985

[30] Foreign Application Priority Data

Dec. 10, 1984 [DE] Fed. Rep. of Germany ... 8436088[U]

[51] Int. Cl.[4] ..... G04B 29/00

[52] U.S. Cl. ..... 368/322; 368/323

[58] Field of Search ..... 368/319, 322, 327

[56] References Cited

U.S. PATENT DOCUMENTS 1,848,562 3/1932 Greenleaf ..... 368/319

*Primary Examiner*—Bernard Roskoski

[57] ABSTRACT

In a drive coupling for the coupling of an adjustment shaft with the ratchet adjusting knob of a wristwatch, a slide bushing which is axially movably disposed on the adjustment shaft has a collar with sections circumferentially punched therefrom and bent axially out of the collar plane so as to form an annular cam and detent structure.

2 Claims, 1 Drawing Sheet

DRIVE COUPLING

BACKGROUND OF THE INVENTION

The invention relates to a drive coupling for the coupling of an adjustment shaft with the ratchet adjusting knob of a watch, especially a wristwatch which includes a slide bushing axially movably disposed on the adjustment shaft and provided with a collar having axially projecting cams and detent structures.

Such watch operating mechanisms are well-known in the prior art.

The manufacture of the slide bushings with such drive couplings is quite difficult; particularly because the parts are so small. It is noted that the slide bushing must be provided with a non-circular central opening and also it must be cut on a lathe to form the collar and the engagement structure for an operating fork. Finally, milling operations are required to form the pawl structure projecting from the collar. The manufacture of such slide bushings and of the associated drive coupling is therefore quite involved and relatively expensive.

It is the object of the present invention to provide slide bushings with drive couplings which are easier and therefore less expensive to manufacture.

SUMMARY OF THE INVENTION

A drive coupling for the coupling of an adjustment shaft with the ratchet adjusting knob of a wristwatch has a slide bushing which is axially movably disposed on the adjustment shaft and which has a collar with sections circumferentially punched therefrom so as to be bent axially out of the collar plane for forming an annular cam and detent structure.

In contrast to prior art arrangements no cam and detent structure is formed so that no milling operation is necessary but pawls are simply punched out of the collar. This process is fast, accurate and inexpensive since no cutting operations are required. The punching of the pawls from the collar is done fully automatically which provides for further expenses resulting in substantial cost savings.

SHORT DESCRIPTION OF THE DRAWINGS

FIG. 1 is an elevational view of the slide bushing, and FIG. 2 is an axial view of the bushing.

DESCRIPTION OF A PREFERRED EMBODIMENT

Figure 1:
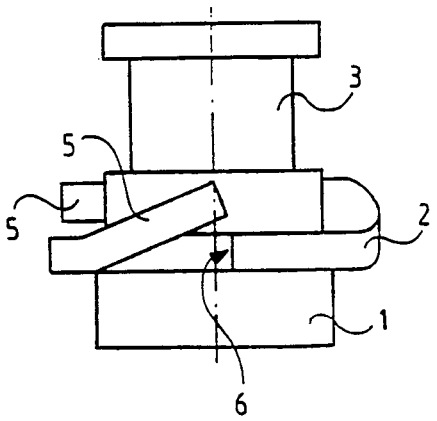

FIG. 1 shows the body 1 of the slide bushing for the manufacture of a drive coupling which body 1 is provided with a collar 2 near one end thereof. Adjacent the other end the bushing is provided with an annular groove 3 adapted to receive a control fork (not shown) for axially moving the slide bushing 1. A non-circular opening 4 extends axially through the slide bushing for engagement with a non-circular shaft.

Figure 2:
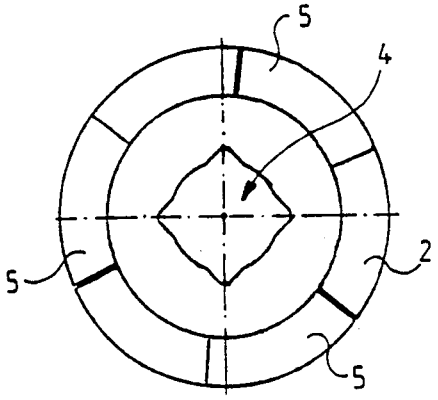

The collar 2 is provided with pawls 5 which are formed in a punching step during which a number of collar portions are separated along planes receiving the axis of the bushing and bent outwardly all in the same axial direction to provide an axial cam or detent structure in a simple manner. It is noted for illustration that the representation of the slide bushing is given in FIGS. 1 and 2 at 30 times of actual size.

I claim:

1. A drive coupling for the coupling of an adjustment shaft with the ratchet adjustment knob of a watch, especially a wristwatch, comprising: a slide bushing axially movably disposed on an adjustment shaft, said bushing having a collar formed thereon which collar has sections circumferentially punched therefrom, said sections being bent axially out of the plane of the collar so as to form an annular cam and detent structure.

* * * * *